US009085926B2

(12) United States Patent
Collinson et al.

(10) Patent No.: US 9,085,926 B2
(45) Date of Patent: Jul. 21, 2015

(54) TRACKLESS FOLDING PANEL GATE

(71) Applicant: Wallace International Ltd., Winnipeg (CA)

(72) Inventors: James George Collinson, Winnipeg (CA); Matthew Raymond Fleury, Ste. Anne (CA); James Robert Buhler, Winnipeg (CA)

(73) Assignee: Wallace International Ltd., Winnipeg, Manituba (CA)

( * ) Notice: Subject to any disclaimer, the term of this patent is extended or adjusted under 35 U.S.C. 154(b) by 188 days.

(21) Appl. No.: 13/924,895

(22) Filed: Jun. 24, 2013

(65) Prior Publication Data

US 2014/0259939 A1 Sep. 18, 2014

Related U.S. Application Data

(60) Provisional application No. 61/791,119, filed on Mar. 15, 2013.

(51) Int. Cl.

| | |
|---|---|
| ***E05F 11/28*** | (2006.01) |
| ***E05F 15/10*** | (2006.01) |
| ***E05F 15/605*** | (2015.01) |

(52) U.S. Cl.

CPC ..... *E05F 15/103* (2013.01); *E05F 15/605* (2013.01); *E05Y 2201/62* (2013.01); *E05Y 2900/40* (2013.01)

(58) Field of Classification Search

CPC .. E05F 15/103; E05F 15/605; E05Y 2900/40; E05Y 2201/62

USPC ..... 49/339, 340, 345; 160/210, 213, 217, 160/218, 188

See application file for complete search history.

(56) References Cited

U.S. PATENT DOCUMENTS

| | | | | |
|---|---|---|---|---|
| 4,233,938 | A * | 11/1980 | Ruetenik | 119/425 |
| 4,545,418 | A * | 10/1985 | List et al. | 160/213 |
| 7,942,185 | B2 | 5/2011 | Long | |
| 8,096,341 | B2 * | 1/2012 | Teunissen | 160/199 |
| 2010/0071264 | A1 * | 3/2010 | Faulkner et al. | 49/26 |
| 2011/0302841 | A1 * | 12/2011 | Ye et al. | 49/340 |
| 2013/0042531 | A1 * | 2/2013 | Hird et al. | 49/246 |

FOREIGN PATENT DOCUMENTS

| | | | | |
|---|---|---|---|---|
| DE | 3515475 | A1 * | 10/1986 | E05F 15/04 |
| GB | 2038438 | A * | 7/1980 | F16P 3/08 |

* cited by examiner

*Primary Examiner* — Jerry Redman

(74) *Attorney, Agent, or Firm* — Ryan W. Duprui; Kyle R. Satterth Waite; Ade & Company Inc.

(57) ABSTRACT

A foldable panel gate includes an inner panel section and an outer panel section foldable relative to one another between open and closed positions of the gate. An operating linkage controls displacement of the outer panel section relative to the inner panel section as the inner panel section is driven by a suitable drive between the open and closed positions. The linkage includes a pivotal body coupled to the inner panel section, a first connecting link pivotally coupled between the gate post and the pivotal body, and a second connecting link pivotally coupled between the pivotal body and the outer panel section to fold the outer panel section relative to the inner panel section through a range of 180 degrees as the inner panel section is driven through a range of 90 degrees between the open and closed position.

17 Claims, 6 Drawing Sheets

TRACKLESS FOLDING PANEL GATE

FIELD OF THE INVENTION

The present invention relates to panel gate comprising one or more leaf assemblies in which each leaf assembly comprises an inner panel section and an outer panel section which is folded relative to the inner section by an operating linkage as the inner section is displaced between closed and open positions such that no track is required to guide the outer section between the closed and open positions.

BACKGROUND

A common configuration of gate involves an inner panel section pivotally coupled to a gate post and an outer panel section coupled to the inner panel section for relative folding movement. The panel sections are movable between a closed position in which the panel sections are substantially co-planar so as to span across a respective portion of a gate opening and an open position in which the panel sections are folded against one another so that the respective portion of the gate opening is unobstructed by the panel sections. A drive is coupled to the inner panel section to typically rotate the inner panel through a range of approximately 90 degrees between the open and closed positions. A track may be used to guide the outer panel section to fold relative to the inner panel section as the inner panel section is folded. Installation of a track, either in the ground or supported on an overhead structure can be costly and time consuming to install, particularly when the ground is uneven or difficult to penetrate.

U.S. Pat. No. 7,942,185 by Long, discloses one example of a folding gate in which one or more outer panel sections is coupled to an adjacent panel section at the inner end thereof by a hinge structure. An operating linkage is coupled between the panel sections to control movement of the outer panel section between the open and closed positions without requiring a track. The operating linkage includes a driven gear on the outer panel section coupled to a drive gear on the adjacent inner panel having a gear ratio relative to one another that causes the outer panel section to be folded through an range of approximately 180 degrees relative to the adjacent inner panel section from the closed position to the open position. The geared connection requires considerable maintenance to operate and may be readily susceptible to breakage such that its use in a security gate may be undesirable.

Another trackless folding gate is available by Gunnebo, known as the Quick Folding Gate. The Quick Folding Gate includes an operating linkage which is coupled between the inner and outer panel sections. The configuration of the linkage however requires that the hinge between the inner and outer panel sections be located within the common plane of the panel sections. The panel sections must be spaced apart in the closed position to accommodate the hinge structure such that the gap represents a hazard which can cause injury to persons as the gate is opened if any limbs are positioned in the gap for example.

SUMMARY OF THE INVENTION

According to one aspect of the present invention there is provided a foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

i) a pivotal body pivotally coupled to the second side of the inner panel section in proximity to the outer end of the inner panel section at a location spaced longitudinally toward the inner end from the outer end;

ii) a first connecting link pivotally coupled at a first end in proximity to the gate post and pivotally coupled at a second end on the pivotal body such that the first connecting link extends generally in the longitudinal direction of the inner panel section in the closed position; and iii) a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the outer panel section being pivotal relative to the inner panel section about a vertical folding axis which is spaced perpendicularly outward from the first sides of the panel sections in the closed position.

The configuration of the operating linkage provides a secure connection between the panel sections and requires minimal maintenance for reliable operation. The outward spacing of the folding axis relative to the panel sections permits the panel sections to be located in close proximity to one another in the closed position by locating the hinge components outside of the common plane of the panel sections.

Preferably a distance in the longitudinal direction of the panel sections in the closed position between a first pivotal connection of the pivotal body relative to the first connecting link and an intermediate pivotal connection of the pivotal body relative to the inner gate panel is less than a distance in the longitudinal direction of the panel sections in the closed position between said intermediate pivotal connection and a second pivotal connection of the pivotal body relative to the second connecting link.

The second connecting link may comprise a curved member having an inner side facing the gate post in the open position which is concave.

Preferably a first pivotal connection of the pivotal body relative to the first connecting link and a second pivotal connection of the pivotal body relative to the second connecting link are equidistant from the panel sections in the closed position.

Preferably a distance in the longitudinal direction of the panel sections in the closed position between an intermediate pivotal connection of the pivotal body relative to the inner gate panel and the folding axis is substantially equal to a distance in the longitudinal direction of the panel sections in the closed position between said intermediate pivotal connection and a pivotal connection of the second connecting link to the outer panel section.

According to a second aspect of the present invention there is provided a foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end;

an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

i) a pivotal body pivotally coupled to the second side of the inner panel section in proximity to the outer end of the inner panel section at a location spaced longitudinally toward the inner end from the outer end;

ii) a first connecting link pivotally coupled at a first end in proximity to the gate post and pivotally coupled at a second end on the pivotal body such that the first connecting link extends generally in the longitudinal direction of the inner panel section in the closed position;

iii) a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

iv) the pivotal body comprising a pair of plate members which are vertically spaced apart from one another and which are coupled to one another by a pivot shaft at a pivotal connection of the pivotal body with each one of the first connector link, the second connector link and the inner panel section; and v) an auxiliary support member connected between the plate members at an intermediate location spaced from each of the pivot shafts.

The auxiliary support member provides structural support to the pivotal body in connection to the first connecting link, the second connecting link, and the inner panel section to ensure a smooth and accurate operation between the open and closed positions and to provide strong support for the panel sections in the closed position.

Preferably the auxiliary support member is connected between the plate members at a central location in the longitudinal direction of the panel sections in the closed position between a first pivotal connection of the pivotal body relative to the first connecting link and a second pivotal connection of the pivotal body relative to the second connecting link.

According to another aspect of the present invention there is provided a foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end;

an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

i) a pivotal body pivotally coupled to the second side of the inner panel section in proximity to the outer end of the inner panel section at a location spaced longitudinally toward the inner end from the outer end;

ii) a first connecting link pivotally coupled at a first end in proximity to the gate post and pivotally coupled at a second end on the pivotal body such that the first connecting link extends generally in the longitudinal direction of the inner panel section in the closed position; and iii) a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

iv) the pivotal body comprising a pair of plate members which are vertically spaced apart from one another and which are coupled to one another by a pivot shaft at a pivotal connection of the pivotal body with each one of the first connector link, the second connector link and the inner panel section; and v) a shroud panel coupled between the plate members along one side of the plates which is opposite from the panel sections and which spans generally in the longitudinal direction of the panel sections in the closed position.

The shroud panel limits access to the operating linkage by unauthorized persons, both to protect the linkage and to protect persons from being injured by being caught in the linkage.

Preferably the shroud panel spans substantially a full length of the pivotal body in the longitudinal direction of the panels sections in the closed position between a first pivotal connection of the pivotal body relative to the first connecting link at a first end of the pivotal body and a second pivotal connection of the pivotal body relative to the second connecting link at a second end of the pivotal body.

According to another aspect of the present invention there is provided a foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

i) a pivotal body pivotally coupled to the second side of the inner panel section in proximity to the outer end of the inner panel section at a location spaced longitudinally toward the inner end from the outer end;

ii) a first connecting link pivotally coupled at a first end in proximity to the gate post and pivotally coupled at a second end on the pivotal body such that the first connecting link extends generally in the longitudinal direction of the inner panel section in the closed position; and iii) a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the pivotal body comprising a pair of plate members which are vertically spaced apart from one another and which are coupled to one another by a pivot shaft at a pivotal connection of the pivotal body with each one of the first connector link, the second connector link and the inner panel section;

wherein at least one of the pivot shafts comprises a shearable member which is arranged to be readily shearable when subjected to a shear force which exceeds a prescribed shearing condition.

The use of shearable members permits the pivot shafts to be the first item to experience damage when the gate is forced open or closed against the action of the drive, for example when a vehicle collides with a closed gate. Accordingly the gate can be readily repaired by replacing the shearable members rather than requiring more costly replacement of the panel sections or other components of the operating linkage for example.

According to yet another aspect of the present invention there is provided a foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

i) a pivotal body pivotally coupled to the second side of the inner panel section in proximity to the outer end of the inner panel section at a location spaced longitudinally toward the inner end from the outer end;

ii) a first connecting link pivotally coupled at a first end in proximity to the gate post and pivotally coupled at a second end on the pivotal body such that the first connecting link extends generally in the longitudinal direction of the inner panel section in the closed position; and iii) a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

wherein the first connector link includes at least one serrated edge extending generally in the longitudinal direction of the panel sections in the closed position.

The serrated edge on the first connector link deters unauthorized persons from climbing over the gate by using the first connector link as a handhold.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
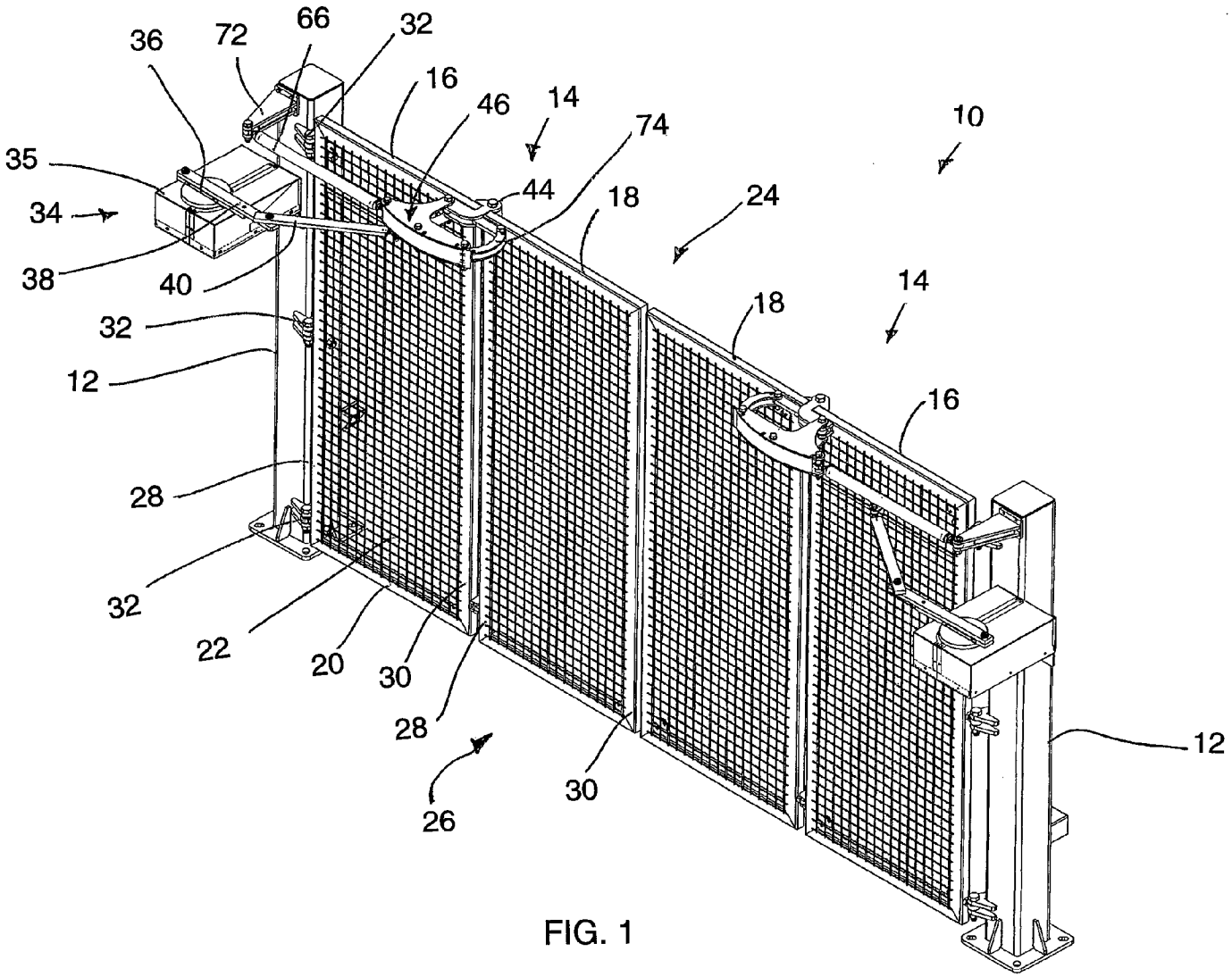
FIG. 1 is a perspective view of a panel gate including two leaf assemblies, each formed of two foldable panel sections in the closed position.
Figure 2:
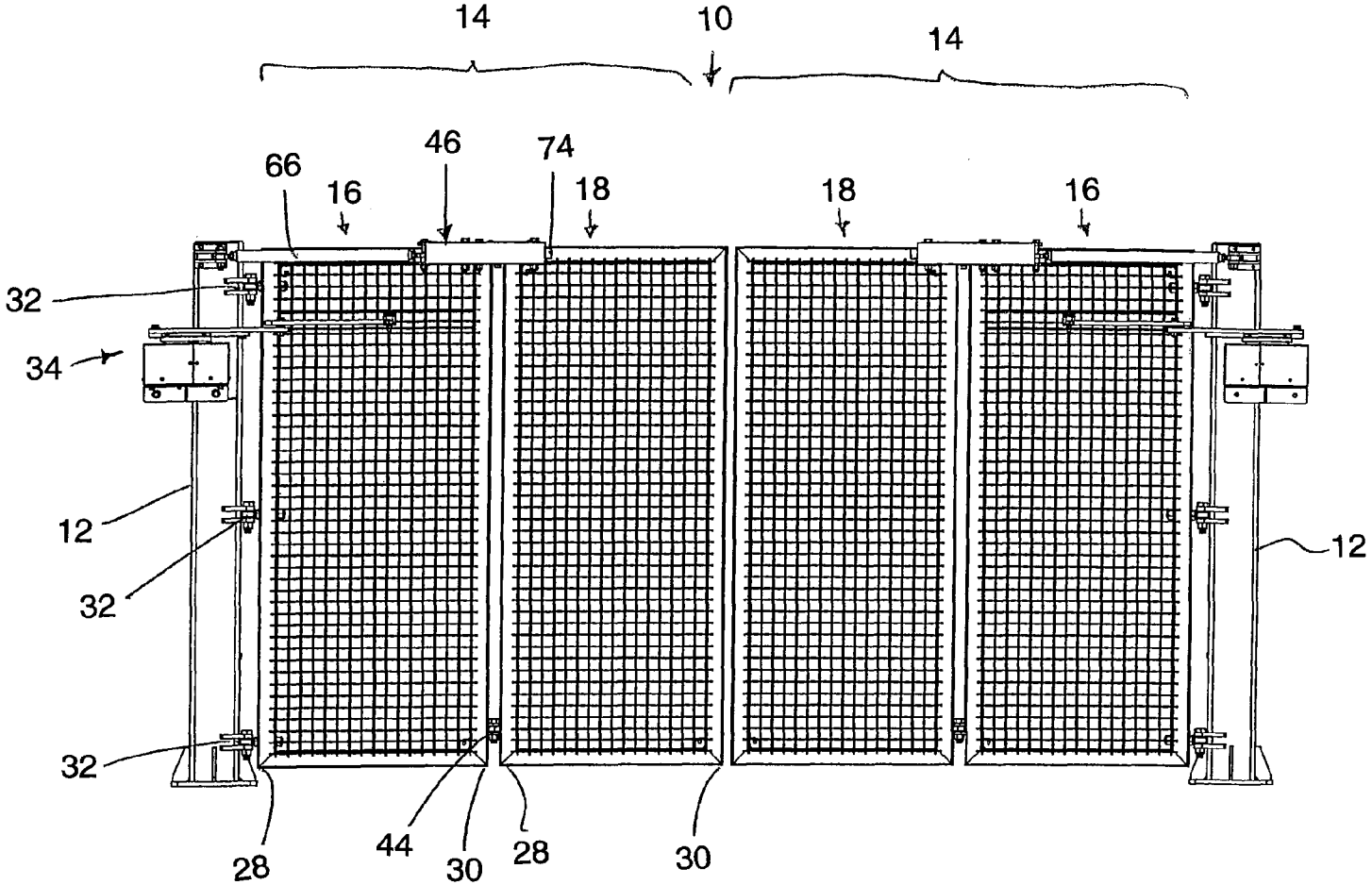
FIG. 2 is a front elevational view of the panel gate in the closed position.
Figure 4:
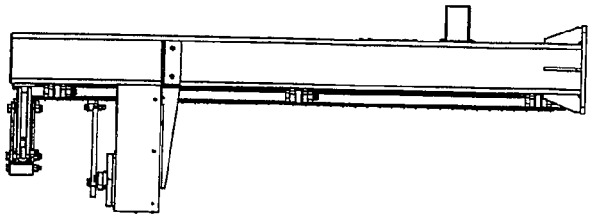
FIG. 4 is an end elevational view of the panel gate in the closed position.
Figure 3:
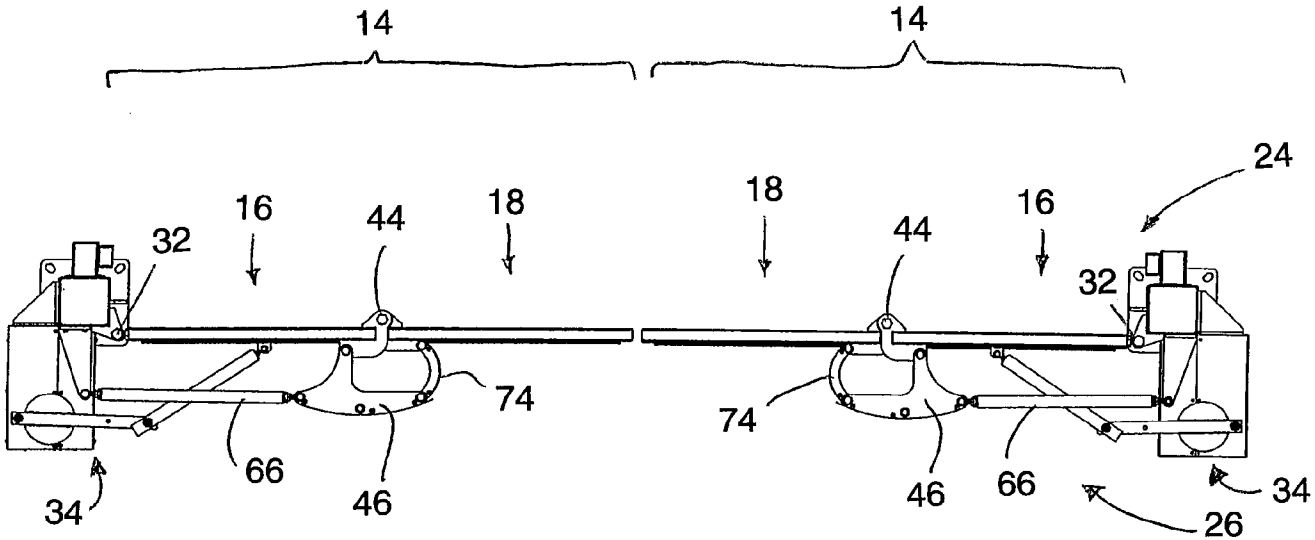
FIG. 3 is a top plan view of the panel gate in the closed position.
Figure 5:
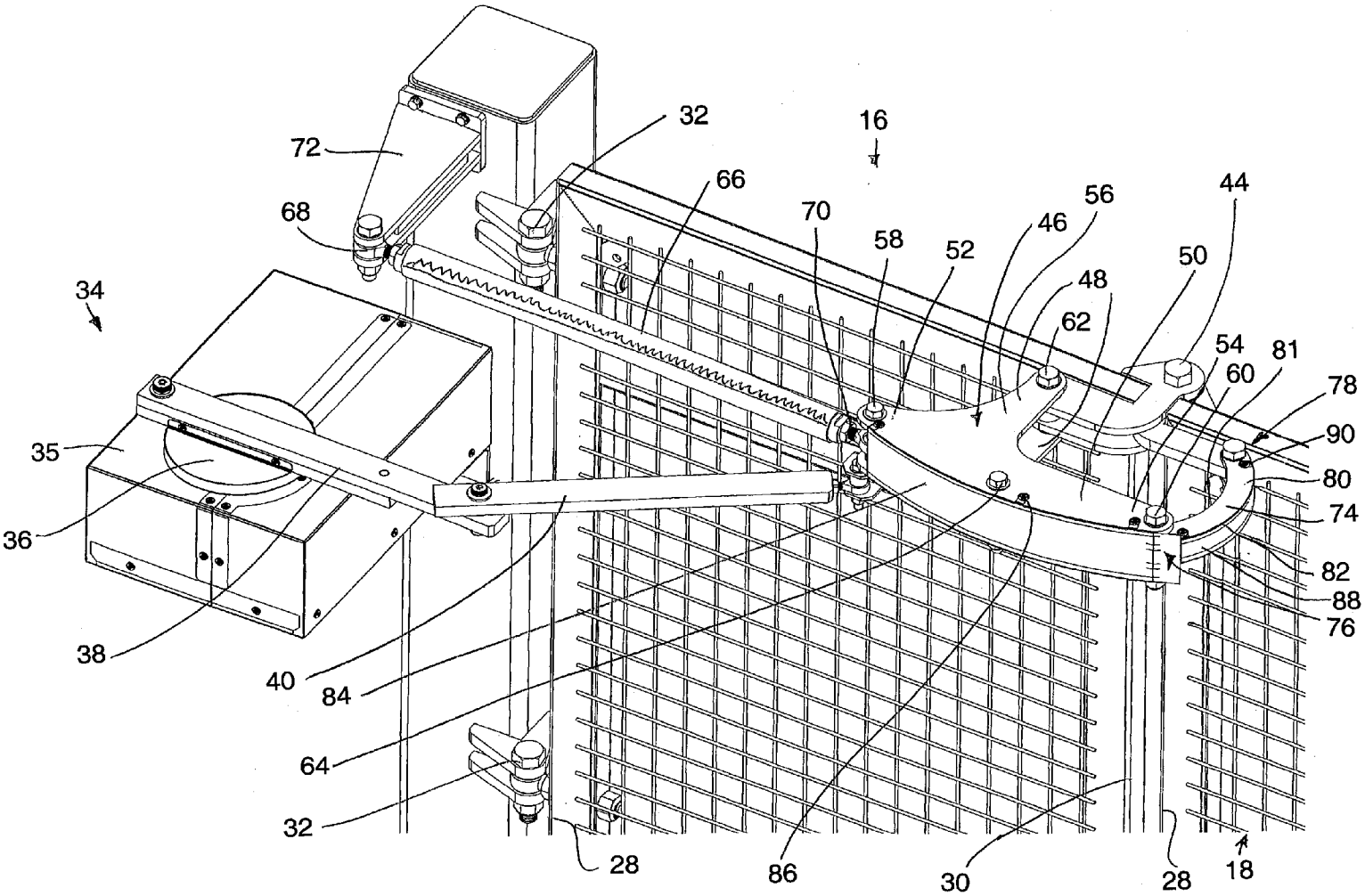
FIG. 5 is a perspective view of the operating linkage of one foldable leaf assembly in the closed position.
Figure 6:
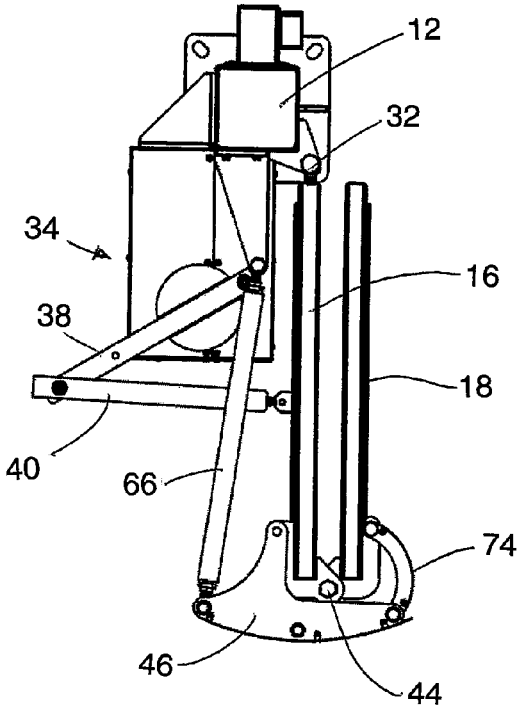
FIG. 6 is a top plan view of the operating linkage of one foldable leaf assembly in the open position.
Figure 7:
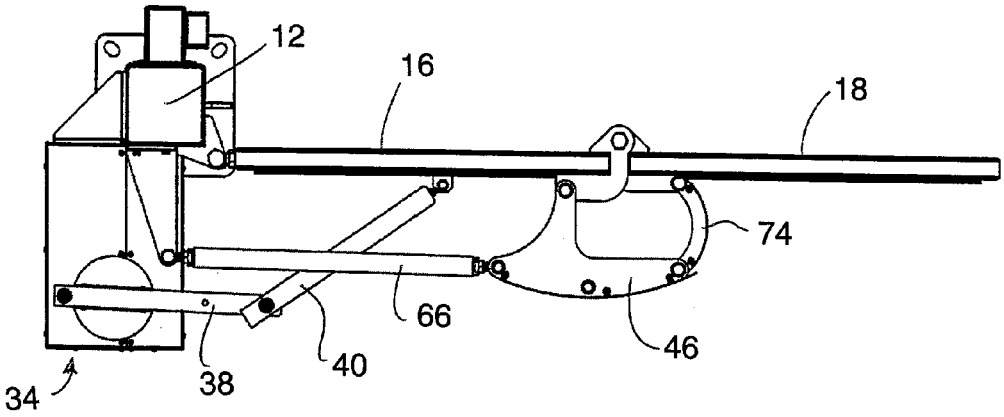
FIG. 7 is a top plan view of the operating linkage of one foldable leaf assembly in the closed position.
Figure 8:
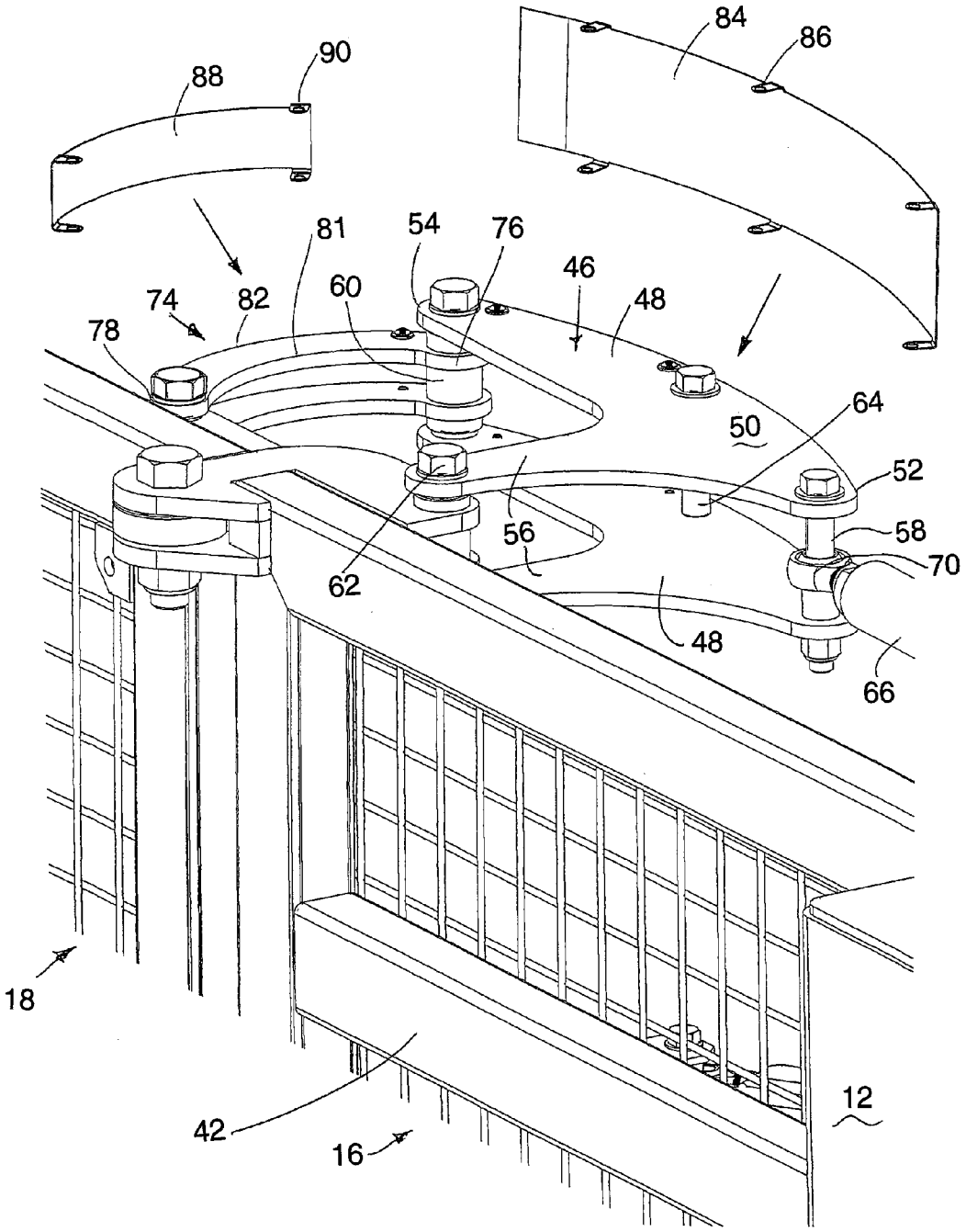
FIG. 8 is another perspective view of the operating linkage of one foldable leaf assembly in the closed position with the shroud assembly shown separated from the pivotal body.

Referring to the accompanying drawings, there is illustrated a panel gate generally indicated by reference numeral 10. The panel gate is foldable between a closed position spanning across a gate opening between two gate posts 12 and an open position in which the gate opening is substantially unobstructed by the gate.

The two gate posts 12 are spaced apart at longitudinally opposed ends of the gate opening. Each post 12 includes a horizontal bottom flange with mounting apertures therein for securement to a suitable foundation, and an upright portion extending vertically upward from the bottom flange to span the full height of the post.

The overall gate 10 in the illustrated embodiment includes two leaf assemblies 14 which each span partway across the gate opening in the closed position so that the two leaf assemblies meet one another at a central location of the gate opening between the two gate posts.

Each leaf assembly is formed of an inner panel section 16 and an outer panel 18. The two panel sections each comprise a perimeter frame member 20 defining a top, a bottom and two sides of the panel in a generally rectangular configuration. Suitable fencing material such as welded wire mesh 22 fully spans the panel section to prevent access of persons therethrough. In the closed position, each panel section includes a first side 24 facing outwardly and an opposing second side 26 facing inwardly such that both opposing sides span in the longitudinal direction of the closed gate between an inner end 28 and an opposing outer end 30.

The inner panel section 16 is hinged at the inner end thereof on the respective gate post for pivotal movement of the inner panel section about a vertical hinge axis between the open and closed positions. A plurality of hinge elements 32 are provided at vertically spaced positions so as to be coupled between the inner end of the panel section and the post. The hinge elements 32 define the vertical hinge axis which lies in a common plane of the inner panel section at the inner end thereof in the closed position. In the closed position, the inner panel section spans across a respective portion of the gate opening from the respective gate post towards the other gate post. The inner panel section is pivoted in the direction of the second side through a range of 90 degrees from the closed position to the open position.

A drive assembly 34 is coupled between the post and the inner panel section for driving the inner panel section between the open and closed positions. The drive assembly 34 includes a housing 35 supported on the post at a location spaced above the ground for receiving a motor therein. A rotary output 36 of the motor protrudes upwardly through the top of the drive housing 35 in which the output 36 of the motor rotates about a vertical drive axis. The vertical drive axis is spaced from the plane of the panel sections in the closed position outward from the second side of the gate.

An output arm 38 of the drive assembly is rotatable with the output 36 of the motor between the closed position in which the arm projects generally parallel to the panel sections from the rotary output axis generally towards the opposing gate post so as to be generally parallel to the panel sections, and an open position in which the arm 38 is rotated away from the location of the panel sections in the closed position through a range of approximately 150 degrees for example.

A connector arm 40 is pivotally connected at an inner end to the output arm 38 at a location spaced from the drive axis. The opposing outer end of the connector arm 40 is pivotally coupled to the inner panel section 16 at a location spaced towards the center in relation to both inner and outer ends of the panel. A cross bar 42 spans horizontally between opposing sides of the perimeter frame of the inner panel section at the location of the connector arm connection to the panel for added structural support. The inner panel section is rotated through 90 degrees from the closed position to the open position as the output arm 38 of the drive assembly is rotated through approximately 150 degrees.

The outer panel section 18 is coupled to the inner panel section by a plurality of hinge elements 44 which are vertically spaced apart at opposing top and bottom ends of the panel sections to define a vertical folding axis of the outer panel section movement relative to the inner panel section. The hinge elements 44 are coupled between the outer end of the inner panel section and the inner end of the outer panel section so as to locate the hinge axis spaced outwardly from a common plane of the panel sections in the closed position in the direction that the first sides of the panels face. In the closed position, the inner and outer panel sections are supported in close proximity to one another due to the hinge elements 44 being offset outwardly from the plane of the panel sections in the closed position.

An operating linkage is coupled between the outer panel section and the post for controlling movement of the outer panel section as the inner panel section is driven between the open and closed positions. More particularly, the operating linkage ensures that the outer panel section is folded through a range of 180 degrees relative to the inner panel section from the closed position where the panels occupy a common plane to the open position. In the open position the first sides 24 of the panel sections are folded together to face one another and be located in close proximity adjacent one another in parallel in relationship. The outward offset of the hinge axis relative to the closed panel sections results in the hinge axis being centrally located between the two panel sections in the open position by a prescribed space which corresponds to twice the offset distance of the hinge axis from each panel. This results in a larger gap between the ends of the panel sections at the hinge axis in the open position than the closed position. The operating linkage is coupled between the top end of the post and the top ends of the inner and outer panel sections.

The operating linkage includes a pivotal body 46 defined by two parallel plate members 48 which are vertically spaced apart from one another in close proximity adjacent the top ends of the panel sections. Each of the two plate members of the body includes a main portion 50 spanning the full length of the body in the longitudinal direction of the closed panel sections from an inner end 52 to an opposing outer end 54. The main portion 50 is spaced outward from the second sides of the closed panel sections but each plate member further includes an anchor portion 56 connecting from an intermediate location along the main portion towards the inner panel section to which it is pivotally coupled.

The two parallel plate members of the pivotal body are joined and held in fixed spaced relation with one another by a plurality of pivot shafts as described herein. A first pivot shaft 58 is coupled vertically between the two plate members 48 at the inner end 52 and a second pivot shaft 60 is similarly vertically coupled between the plates adjacent the outer end 54. An intermediate pivot shaft 62 spans vertically between the plates at the end of the anchor portion 56 closest to the panel sections to define the pivotal coupling of the pivotal body to the inner panel section. Finally, an auxiliary pivot shaft 64 is coupled vertically between the plates at a longitudinally centered location between the first and second pivot shafts within the main portion 50 of the pivotal body opposite from the anchor portion 56.

The operating linkage further includes a first connector link 66 which extends between a first end 68 pivotally coupled relative to the gate post and a second end 70 which is pivotally coupled to the first pivot shaft 58 of the pivotal body. An anchor member 72 is fixed on the top end of the post to project outwardly from a plane of the panel sections in the closed position in the direction that the second sides of the panels face at a location above the drive housing. The first end of the first connector link 66 is pivotally mounted on the anchor 72 at a location spaced perpendicularly outward from the common plane of the panel sections in the closed position by a distance similar to the location of the first pivot shaft 58 relative to the common plane of the panel sections in the closed position such that the first connector link extends generally parallel to the panel sections in the closed position.

A second connector link 74 extends between a first end 76 pivotally coupled to the second pivot shaft 60 and a second end 78 which is pivotally coupled to the outer panel section. The second connector link is defined by a pair of horizontally oriented and parallel plates 80 which are coupled at vertically spaced positions to the second pivot shaft. The plates 80 of the second connector link 74 are connected to the second pivot shaft between the connection of the two plate members 48 of the pivotal body. In the open position an inner side 81 of the second connector link which faces towards the gate post coupling the inner end of the respective inner panel section thereon is concave while the opposing outer side 82 facing the outer end of the outer panel section is generally convex.

In the closed position of the gate, the first and second pivot shafts are located at a substantially equal distance from the common plane of the panel sections. The auxiliary pivot shaft 64 is also located at a similar distance from the common plane of the panel sections, but at a location spaced slightly outward in relation to the first and second pivot shafts. The auxiliary pivot shaft is generally centered in the longitudinal direction of the closed panels between the first and second pivot shafts.

The intermediate pivot shaft is located adjacent the second side of the inner panel section in proximity to the outer end of the inner panel section but at a location spaced longitudinally inward along the panel towards the inner end of the panel by a prescribed first distance. The second connector link 74 is in turn pivotally connected to the outer panel section at the second side thereof in proximity to the inner end of the outer panel but at a location spaced outward towards the outer end in the longitudinal direction by a prescribed second distance. The prescribed first distance and the prescribed second distance are substantially equal.

Furthermore, the second pivot shaft in the closed position is arranged to be spaced outwardly in the longitudinal direction of the closed panels beyond the outer end of the inner panel section so as to be spaced outward from the inner end of the outer panel also. As measured in the longitudinal direction of the closed panel sections, the distance between the first pivot shaft and the intermediate pivot shaft is arranged to be much less than the distance between the intermediate shaft and the second pivot shaft.

In this instance, the second connecting link 74 is arranged to form a generally U-shaped configuration with the main portion and anchor portion of the pivotal body which extends about the ends of the inner and outer panel sections coupled at the folding hinge axis in the open position. The dimension in the longitudinal direction in the closed position from the intermediate pivot shaft to the second pivot shaft is thus arranged to bridge across the space between the inner and outer panel sections folded together in the open position and spaced apart from one another due to the offset hinge axis.

A first shroud panel 84 is coupled to the pivotal body 46 to span between the parallel plate members 48 along one side of the pivot body which extends generally in the longitudinal direction of the closed gate panels and which is opposite from the panel sections. The first shroud panel extends vertically between the plate members 48 along the full length of the main portion between the inner end 52 and the outer end 54. Fastener tabs 86 are provided at longitudinally spaced positions along top and bottom edges to permit fasteners to be received therethrough for fastening to respective top and bottom ones of the two plate members 48.

A second shroud panel 88 is also mounted on the second connector link 74 to span vertically between the two plates 80 thereof along the full length of the outer convex side 82 between the opposing first and second ends. The second shroud panel 88 also includes fastener tabs 90 spaced apart at opposing ends of the top and bottom edges for fastening to respective ones of the two plates 80 of the connector link. The shroud panels prevent access of debris to the linkage from the outer sides facing outwardly from the gate panels. Furthermore, the shroud panels prevent access by unauthorized persons to prevent tampering with the linkage and to prevent injury to persons.

The pivot shafts of the pivotal body 46, and more particularly, the first and second pivot shafts, may comprise shearable members which are arranged to be readily shearable when subjected to a shear force which exceeds a prescribed shearing limit. In this instance, if the operating linkage is forced against the prescribed position of the drive, instead of deforming elements of the gate panel, the pivot shafts are arranged to shear before any deformation occurs to minimize damage and simplify the repair process of the gate by simply requiring replacement of the sheared shafts.

The first connector link is typically arranged to be adjustable in length to provide some fine tuning of the adjustment of the operating linkage to ensure a smooth operation of the panel sections from the closed position spanning across respective portions of the gate opening to the open position in which the gate opening is substantially unobstructed by the panel sections.

To further prevent access by unauthorized persons or undesirable tampering, the first connector link can be provided with a serrated edge 92, which may be located for example on an upper edge, and which spans the full length of the connector link between the opposing first and second ends thereof.

Each of the pivotal connections of the operating linkage is typically provided with various bushings or bearings to locate the various components in the vertical direction along the respective pivot shafts and to ensure smooth rotation of the components relative to one another about the respective upright pivot axes defined by the pivot shafts.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

a pivotal body pivotally coupled to the second side of the inner panel section in proximity to the outer end of the inner panel section at a location spaced longitudinally toward the inner end from the outer end;

a first connecting link pivotally coupled at a first end in proximity to the gate post and pivotally coupled at a second end on the pivotal body such that the first connecting link extends generally in the longitudinal direction of the inner panel section in the closed position; and a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the outer panel section being pivotal relative to the inner panel section about a vertical folding axis which is spaced perpendicularly outward from the first sides of the panel sections in the closed position.

2. The gate according to claim 1 wherein a distance in the longitudinal direction of the panel sections in the closed position between a first pivotal connection of the pivotal body relative to the first connecting link and an intermediate pivotal connection of the pivotal body relative to the inner gate panel is less than a distance in the longitudinal direction of the panel sections in the closed position between said intermediate pivotal connection and a second pivotal connection of the pivotal body relative to the second connecting link.

3. The gate according to claim 1 wherein the second connecting link is a curved member having an inner side facing the gate post in the open position which is concave.

4. The gate according to claim 1 wherein a first pivotal connection of the pivotal body relative to the first connecting link and a second pivotal connection of the pivotal body relative to the second connecting link are equidistant from the panel sections in the closed position.

5. The gate according to claim 1 wherein a distance in the longitudinal direction of the panel sections in the closed position between an intermediate pivotal connection of the pivotal body relative to the inner gate panel and the folding axis is substantially equal to a distance in the longitudinal direction of the panel sections in the closed position between said intermediate pivotal connection and a pivotal connection of the second connecting link to the outer panel section.

6. The gate according to claim 1 wherein the pivotal body comprises a pair of plate members which are vertically spaced apart from one another, the pair of plate members being coupled to one another by a pivot shaft at a pivotal connection of the pivotal body with each one of the first connector link, the second connector link and the inner panel section, and wherein the gate further comprises an auxiliary support member connected between the plate members at an intermediate location spaced from each of the pivot shafts.

7. The gate according to claim 6 wherein the auxiliary support member is connected between the plate members at a central location in the longitudinal direction of the panel sections in the closed position between a first pivotal connection of the pivotal body relative to the first connecting link and a second pivotal connection of the pivotal body relative to the second connecting link.

8. The gate according to claim 1 wherein the pivotal body comprises a pair of plate members which are vertically spaced apart from one another, the pair of plate members being coupled to one another by a pivot shaft at a pivotal connection of the pivotal body with each one of the first connector link, the second connector link and the inner panel section, and wherein the gate further comprises a shroud panel coupled between the plate members along one side of the plates which is opposite from the panel sections and which spans generally in the longitudinal direction of the panel sections in the closed position.

9. The gate according to claim 8 wherein the shroud panels spans substantially a full length of the pivotal body in the longitudinal direction of the panels sections in the closed position between a first pivotal connection of the pivotal body relative to the first connecting link at a first end of the pivotal body and a second pivotal connection of the pivotal body relative to the second connecting link at a second end of the pivotal body.

10. The gate according to claim 1 wherein the pivotal body comprises a pair of plate members which are vertically spaced apart from one another, the pair of plate members being coupled to one another by a pivot shaft at a pivotal connection of the pivotal body with each one of the first connector link, the second connector link and the inner panel section, and wherein at least one of the pivot shafts comprises a shearable member which is arranged to be readily shearable when subjected to a shear force which exceeds a prescribed shearing condition.

11. The gate according to claim 1 wherein the first connector link includes at least one serrated edge extending generally in the longitudinal direction of the panel sections in the closed position.

12. A foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end;

an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

a pivotal body pivotally coupled to the second side of the inner panel section in proximity to the outer end of the inner panel section at a location spaced longitudinally toward the inner end from the outer end;

a first connecting link pivotally coupled at a first end in proximity to the gate post and pivotally coupled at a second end on the pivotal body such that the first connecting link extends generally in the longitudinal direction of the inner panel section in the closed position;

a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the pivotal body comprising a pair of plate members which are vertically spaced apart from one another and which are coupled to one another by a pivot shaft at a pivotal connection of the pivotal body with each one of the first connector link, the second connector link and the inner panel section; and an auxiliary support member connected between the plate members at an intermediate location spaced from each of the pivot shafts.

13. The gate according to claim 12 wherein the auxiliary support member is connected between the plate members at a central location in the longitudinal direction of the panel sections in the closed position between a first pivotal connection of the pivotal body relative to the first connecting link and a second pivotal connection of the pivotal body relative to the second connecting link.

14. A foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end;

an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

a pivotal body pivotally coupled to the second side of the inner panel section in proximity to the outer end of the inner panel section at a location spaced longitudinally toward the inner end from the outer end;

a first connecting link pivotally coupled at a first end in proximity to the gate post and pivotally coupled at a second end on the pivotal body such that the first connecting link extends generally in the longitudinal direction of the inner panel section in the closed position; and a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the pivotal body comprising a pair of plate members which are vertically spaced apart from one another and which are coupled to one another by a pivot shaft at a pivotal connection of the pivotal body with each one of the first connector link, the second connector link and the inner panel section; and a shroud panel coupled between the plate members along one side of the plates which is opposite from the panel sections and which spans generally in the longitudinal direction of the panel sections in the closed position.

15. The gate according to claim 14 wherein the shroud panel spans substantially a full length of the pivotal body in the longitudinal direction of the panels sections in the closed position between a first pivotal connection of the pivotal body relative to the first connecting link at a first end of the pivotal body and a second pivotal connection of the pivotal body relative to the second connecting link at a second end of the pivotal body.

16. A foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

a pivotal body pivotally coupled to the second side of the inner panel section in proximity to the outer end of the inner panel section at a location spaced longitudinally toward the inner end from the outer end;

a first connecting link pivotally coupled at a first end in proximity to the gate post and pivotally coupled at a second end on the pivotal body such that the first connecting link extends generally in the longitudinal direction of the inner panel section in the closed position; and a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

the pivotal body comprising a pair of plate members which are vertically spaced apart from one another and which are coupled to one another by a pivot shaft at a pivotal connection of the pivotal body with each one of the first connector link, the second connector link and the inner panel section;

wherein at least one of the pivot shafts comprises a shearable member which is arranged to be readily shearable when subjected to a shear force which exceeds a prescribed shearing condition.

17. A foldable panel gate for being supported adjacent a respective gate opening, the foldable panel gate comprising:

a gate post for being supported in proximity to the gate opening;

an inner panel section having a first side and a second side spanning in a respective longitudinal direction between an inner end pivotally coupled to the gate post and an opposing outer end;

a drive coupled to the inner panel section so as to be arranged to drive the inner panel between a closed position spanning partway across the gate opening and an open position in which the gate opening is substantially unobstructed by the inner panel section;

an outer panel section having a first side and a second side spanning in a respective longitudinal direction between an inner end pivotally coupled to the outer end of the inner panel section and an opposing outer end; and an operating linkage coupled between the inner and outer panel sections so as to be arranged to control displacement of the outer panel section together with the inner panel section between the closed position in which the outer panel section is substantially co-planar with the inner panel section so as to span across a respective portion of the gate opening and the open position in which the outer panel section is folded alongside the inner panel section such that the first sides of the panel sections are adjacent one another, the operating linkage comprising:

a pivotal body pivotally coupled to the second side of the inner panel section in proximity to the outer end of the inner panel section at a location spaced longitudinally toward the inner end from the outer end;

a first connecting link pivotally coupled at a first end in proximity to the gate post and pivotally coupled at a second end on the pivotal body such that the first connecting link extends generally in the longitudinal direction of the inner panel section in the closed position; and a second connecting link pivotally coupled at a first end on the pivotal body at a location spaced in the longitudinal direction of the inner panel section beyond the outer end of the inner panel section in the closed position and pivotally coupled at a second end on the outer panel section in proximity to the inner end of the outer panel section at a location spaced longitudinally toward the outer end from the inner end;

wherein the first connector link includes at least one serrated edge extending generally in the longitudinal direction of the panel sections in the closed position.

* * * * *